US012128991B2

(12) United States Patent
Bertin

(10) Patent No.: US 12,128,991 B2
(45) Date of Patent: Oct. 29, 2024

(54) GUIDED LIFTING SYSTEM

(71) Applicant: CALZONI S.R.L., Calderara di Reno (IT)

(72) Inventor: Daniele Maria Bertin, Milan (IT)

(73) Assignee: CALZONI S.R.L., Calderara di Reno (IT)

( * ) Notice: Subject to any disclaimer, the term of this patent is extended or adjusted under 35 U.S.C. 154(b) by 348 days.

(21) Appl. No.: 17/500,283

(22) Filed: Oct. 13, 2021

(65) Prior Publication Data

US 2022/0126952 A1 Apr. 28, 2022

(30) Foreign Application Priority Data

Oct. 23, 2020 (IT) ..... 102020000025198

(51) Int. Cl.
*B63B 23/48* (2006.01)
*B63B 27/16* (2006.01)

(52) U.S. Cl.
CPC ..... *B63B 23/48* (2013.01); *B63B 2027/165* (2013.01)

(58) Field of Classification Search
CPC ..... B63B 23/48; B63B 23/34; B63B 23/04; B63B 2027/165; B63B 27/16; B63B 27/36; B63B 27/08
See application file for complete search history.

(56) References Cited

U.S. PATENT DOCUMENTS 5,253,606 A 10/1993 Ortelli
6,826,452 B1 11/2004 Holland et al.
2009/0308299 A1* 12/2009 Luccioni ..... B63G 8/001 114/230.1
2013/0220205 A1* 8/2013 Henriksen ..... B63B 23/48 114/268
2014/0086719 A1* 3/2014 Gerard ..... B63C 3/06 254/290
2020/0180740 A1 6/2020 Christ et al.

FOREIGN PATENT DOCUMENTS

CN 102976200 A 3/2013
KR 20150040844 4/2015
KR 20180023280 3/2018
WO 2019115262 A1 6/2019
WO 2020212269 A1 10/2020
WO 2021002749 A1 1/2021

OTHER PUBLICATIONS

Italian Search Report dated Jun. 29, 2021 from counterpart Italian App No. IT 202000025198.
Korean Office Action dated Aug. 23, 2024 from counterpart Korean App No. 10-2021-0139332.
European Office Action dated Apr. 30, 2024 from counterpart European Patent Application No. 21202756.9.

* cited by examiner

*Primary Examiner* — Glenn F Myers
(74) *Attorney, Agent, or Firm* — SHUTTLEWORTH INGERSOLL, P.L.C.

(57) ABSTRACT

A guided lifting system, including:
a lifting unit, installable on a loading deck and configured to exert a lifting force that has at least one vertically directed component;
a pick-up module, associated with the lifting unit and configured to hook a vehicle to be lifted;
characterised in that:
it includes a guide device, connected to the pick-up module and configured to move the pick-up module in space in a guided manner;
the guide device can be actuated and controlled autonomously from the lifting unit.

16 Claims, 5 Drawing Sheets

GUIDED LIFTING SYSTEM

This application claims priority to Italian Patent Application 102020000025198 filed Oct. 23, 2020, the entirety of which is incorporated by reference herein.

The present invention relates to a guided lifting system.

The invention is useful in the naval sector, but not exclusively, for lifting vehicles on board a surface deck such as, for example, a fixed or anchored structure or a ship.

The vehicles may be for example boats or underwater vehicles that re-emerge to be recovered. The vehicles may have personnel on board or, more frequently, be unmanned. For the purpose of the present invention, vehicles that are not already connected such as Underwater Unmanned Vehicles (UUV), Autonomous Underwater Vehicles (AUV) or Unmanned Surface Vehicles or Autonomous Surface Vehicles (ASV) are particularly significant. The recovery of a vehicle on board a surface structure is a complicated activity, which requires the use of personnel. The main difficulty is due to the independent motion of the vehicle with respect to the deck, because of the wave motion, which does not allow an easy connection between the deck and the vehicle. In addition to such difficulty, lifting is also problematic because, as a consequence of the aforesaid motion, the connected vehicle can move dangerously in the directions enabled for the lifting means and end up banging against the side of the deck.

Lifting systems on board a surface deck currently comprise a towing device, e.g. a winch or a hoist associated with an arm or a crane, provided with a hook or another connection means to the vehicle to be lifted, and a guide device, whose aim is to contain the oscillations of the connection means.

A solution is known which envisages a pick-up element, associated with an articulated arm moved vertically by a bar for compensating the motions of the deck. Such solution, described in publication U.S. Pat. No. 5,253,606, does not enable the effective centring of the automatic hook with respect to a vehicle to be lifted, as the articulated arm has a limited number of degrees of freedom.

Another known solution, described in publication WO/2019/115262, envisages a crane provided with a motorised robotic arm which is connected to the vehicle on the basis of sensors and vehicle recognition elements. This solution can only be used for short distances between the deck and the vehicle, because of the very high loads exerted on the robotised arm.

Furthermore, the lifting systems currently available are generally very heavy, as they envisage the use of cranes and/or articulated arms which are rather large and complex.

The object of the present invention is to provide a guided lifting system that enables the drawbacks of the currently available lifting systems to be obviated.

The main advantage of the guided lifting system according to the present invention is that it enables guidance in the space of the connection means intended to be hooked to the vehicle to be lifted. This enables the system to be able to follow the oscillations of the vehicle, so as to hook it automatically.

Another advantage of the lifting system according to the present invention is that it enables effective guidance of the connection means also during lifting, limiting the oscillations of the lifted vehicle.

A further advantage of the lifting system according to the present invention is that of being markedly lighter than currently available lifting systems.

Additional features and advantages of the present invention will become more apparent from the following detailed description of an embodiment of the invention, illustrated by way of non-limiting example in the appended figures, in which:

FIG. 1 shows a schematic view of the lifting system according to the present invention;

FIG. 1*a* is an enlargement of FIG. 1;

Figure 1:
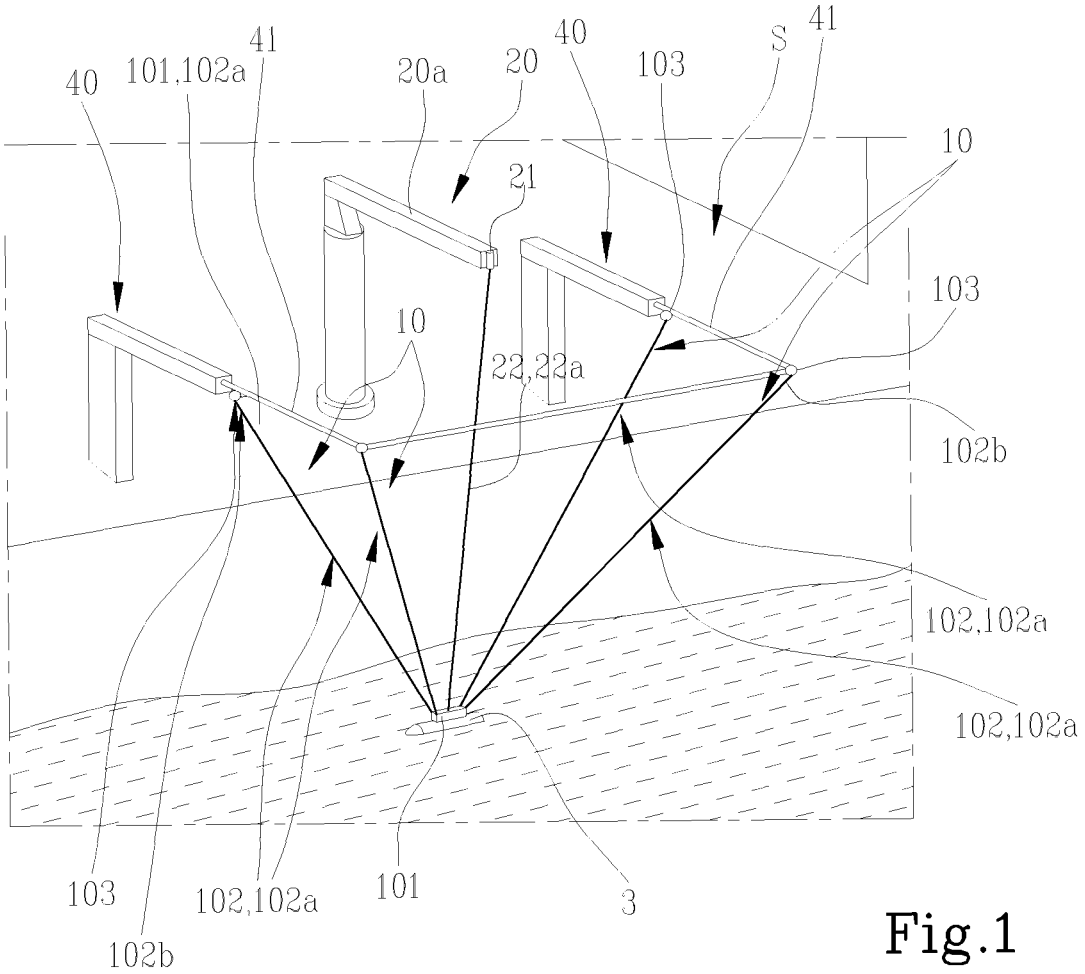
Figure 1A:
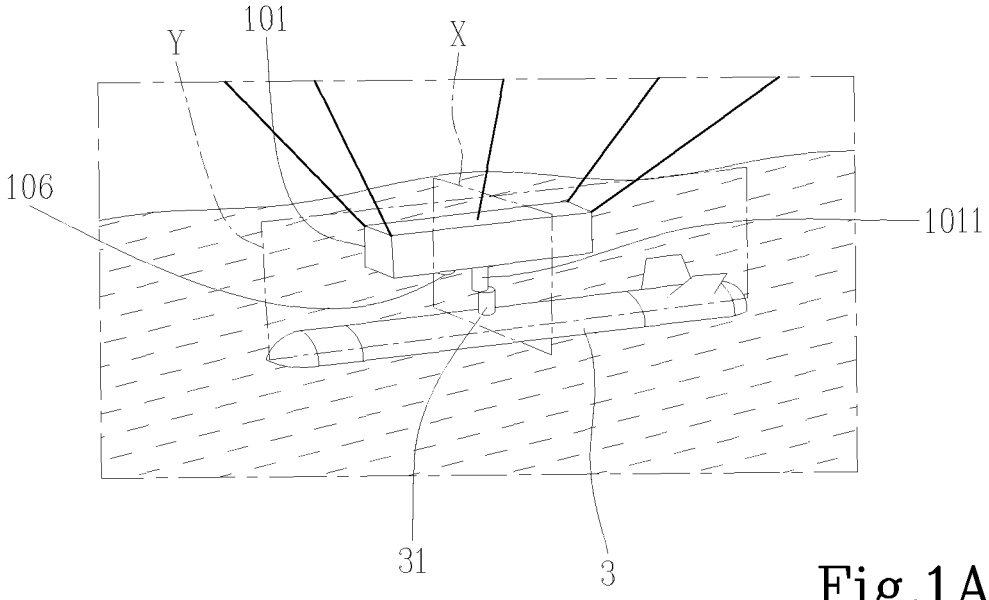

The figures show some examples of vehicles (3), i.e. vessels, which can be lifted and lowered by means of the lifting system according to the present invention.

In general, for each vehicle (3) it is possible to define a longitudinal medium plane (Y), i.e. a substantially vertical plane on which the centre of gravity of the vehicle lies and is directed parallel to the length of the vehicle, where length means a dimension of the vehicle measured parallel to the normal movement or navigation direction.

For each vehicle, it is also possible to identify a transverse medium plane (X), i.e. a substantially vertical plane, perpendicular to the longitudinal medium plane (Y), on which the centre of gravity of the vehicle (3) lies.

Through the lifting system according to the present invention, the vehicle (3) can be hoisted or lowered with respect to a loading deck (S). The deck (S) may be, for example, a bridge of a ship or a floating or anchored structure in general.

The guided lifting system according to the present invention comprises a lifting unit (20), installable on the deck (S). The lifting unit (20) is configured to exert a lifting force that has at least one vertically directed component. In substance, the lifting unit (20) is a device arranged to lift the vehicle (3), i.e. to exert a sufficient lifting force to hoist the vehicle (3) onto the deck (S). The lifting unit (20) is also suitable for lowering the vehicle (3) from the deck (S).

In a possible, preferred but not exclusive, embodiment, the lifting unit (20) comprises a cable (22), connected to a pick-up module (101) which will be more fully described in the following. In the following description, cable means a flexible element suitable to support a traction force, such as a rope or a chain.

The cable (22) is associated with a winding means (21), e.g. a rotary winding and unwinding drum. The winding means (21) is installable on the deck (S).

The lifting unit (20) is structured so that at least one terminal section (22*a*) of the cable (22) is suspended cantilevered outside the deck (A), i.e. suspended outside the perimeter of the deck (S). The terminal section of the cable (22) comprises an end with which the pick-up module (101) is associated, which is likewise suspended cantilevered outside the deck (S). In this way, the pick-up module (101) can be lowered below the level of the deck (S), i.e. the terminal section (22*a*) and the pick-up module (101) can be lowered or raised vertically, next to the deck (S), above and below the level of the deck (S).

In one embodiment, illustrated in FIG. 1, the lifting unit (20) is in the form of a crane, provided with an arm (20*a*) which projects cantilevered outside the deck (S). In this case, the cable (22) is supported and guided by the arm in a known way in the sector, through one or more return pulleys. The terminal section (22*a*) of the cable (22) hangs downwards from the end of the arm (20*a*) and can have a variable length, according to the lifting height of the pick-up module (101).

Figure 2:
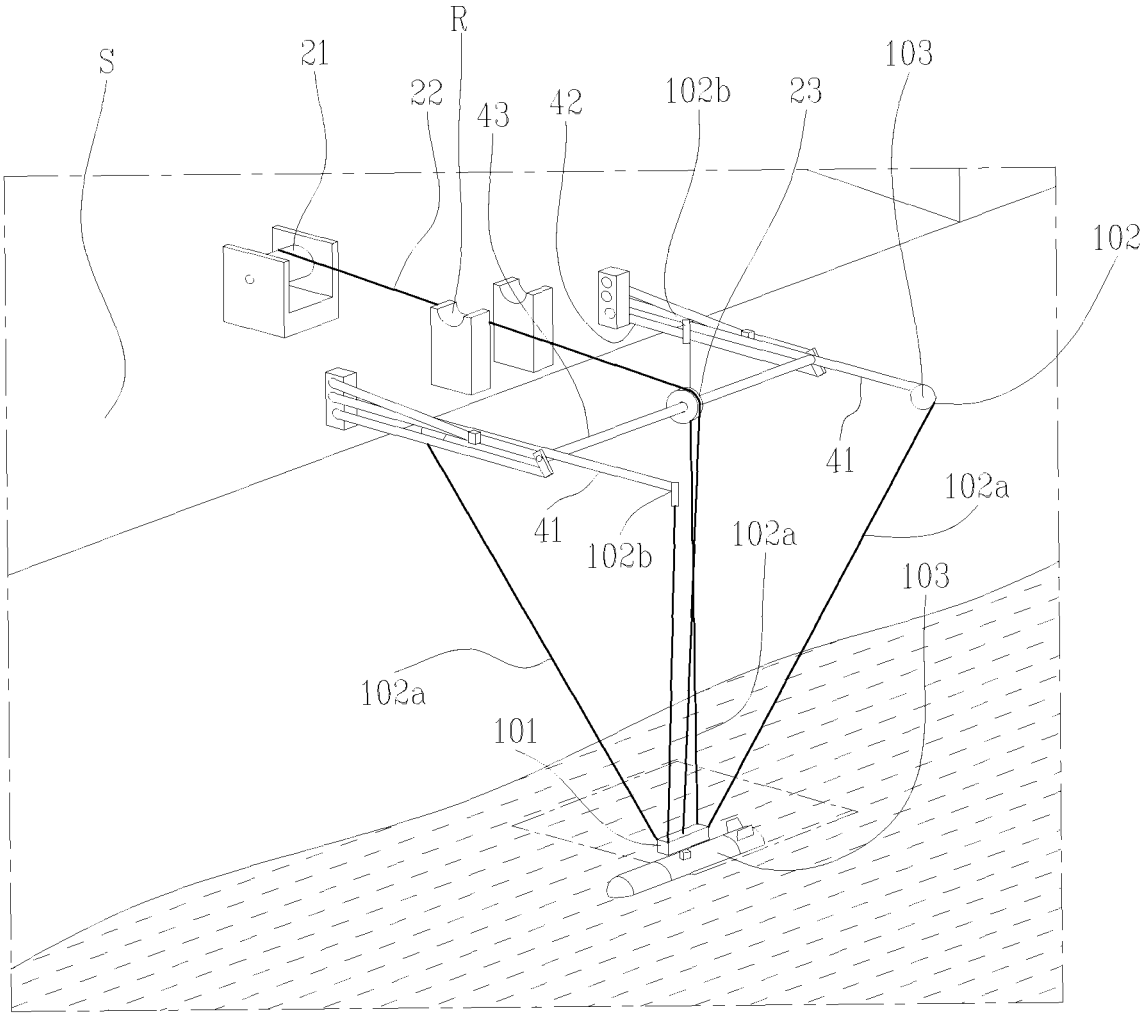
FIGS. 2, 3 and 4 show a second embodiment of the lifting system according to the present invention, in three different operating configurations.
Figure 3:
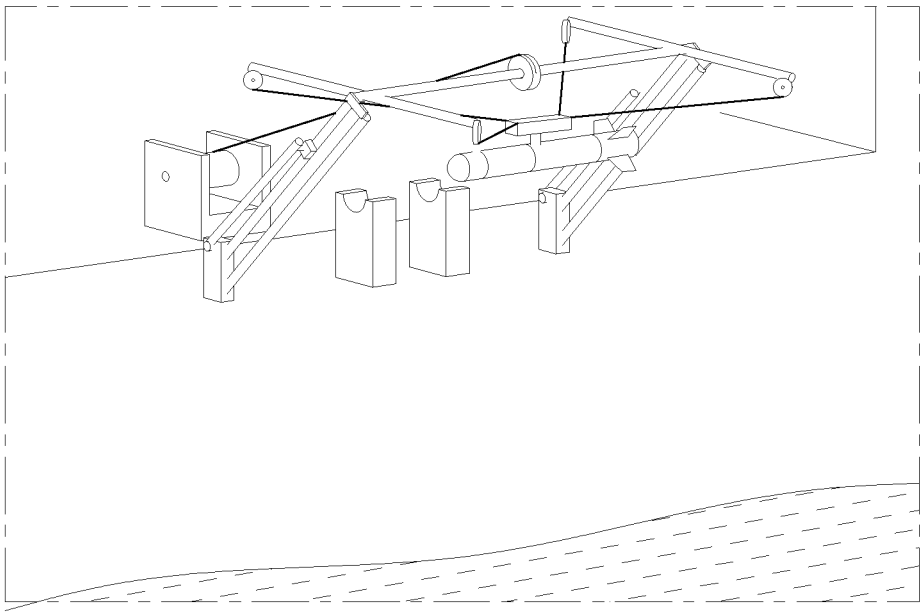
Figure 4:
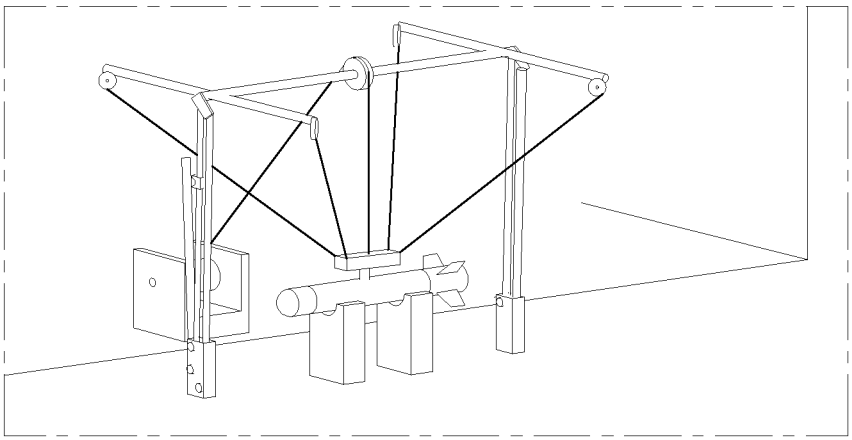

In another possible embodiment, illustrated in FIG. 2, the winding means (21) is installable on top of the deck (S), or on a structure connected thereto. The cable (22) is supported and guided by at least one pulley (23), supported cantilevered outside the deck (S), so that the terminal section (22*a*) hangs cantilevered outside the deck (S), as in the case of the crane. The pulley (23) is supported by a structure that will be more fully described in the following.

The pick-up module (101) is associated with the lifting unit (20) and is configured to hook a vehicle (3). In particular, in the illustrated embodiment, the pick-up module (101) is associated with the end of the terminal section (22*a*) of the cable (22). The pick-up module (101) may be of the mechanical, electromechanical or magnetic type, or a combination of the three hooking types.

A coupling module (31) is configured for hooking, upon command, to the pick-up module (101). The coupling module (31) is configured to be connected to the vehicle (3). The structure of the coupling module (31) is compatible with the structure of the pick-up module (101), to enable a stable hooking with the latter.

Both for the pick-up module (101), and for the coupling module (31) various embodiments are available, known to a person skilled in the art, which will therefore not be described in detail.

Advantageously, the lifting system according to the present invention comprises a guide device (10), connected to the pick-up module (101) and configured to move the pick-up module (101) in space in a guided manner. For example, the guide device (10) can direct the pick-up module (101), during descent, towards a specific zone of the vehicle (3), for example towards the coupling module (31). Furthermore, the guide device (10) can move the pick-up module (101) so as to compensate for any oscillations produced by the wave motion or other unexpected movements of the deck (S) and/or of the vehicle (3).

Advantageously, the guide device (10) can be actuated and controlled autonomously from the lifting unit (20). In other words, the lifting unit (20) performs the task of lifting or lowering the pick-up module (101), i.e. of moving the pick-up module (101) along a substantially vertical direction, fully supporting the load of the vehicle (3). The guide device (10) is structured to intervene autonomously so as to move the pick-up module (101) in space, substantially without supporting the load of the vehicle (3). In this way, the guide device (10) can be structured in a simple and light way, having to be limited to guiding the pick-up module (101). In the same way, also the lifting unit (20) can assume a very simple structure, of the type described above, substantially like a winch or hoist, possibly associated with a crane.

Preferably, the lifting system according to the present invention comprises a control module (107), connected to the guide device (10) and configured to actuate the guide device (10) so as to move the pick-up module (101) in a pre-established manner. Advantageously, the control module (107) operates the activation of the guide device (10) as a function of one or more significant signals of the position of the pick-up module (101) and/or of the vehicle (3) and/or of the relative position of the pick-up module (101) with respect to the vehicle (3). For that purpose, one or more sensors are provided which will be more fully described in the following.

In a possible embodiment, the guide device (10) comprises three winches or hoists (102,103), each of which comprises a cable (102), associated with the pick-up module (101), and a winding means (103), configured to wind or unwind the respective cable (102). Each cable (102) is oriented so as to exert, on the pick-up module (101), a traction which has at least one component directed onto a horizontal plane. In this way, the combined action of the three cables (102) enables the pick-up module (101) to be moved in a predetermined way on a horizontal plane. The movement of the pick-up module (101) along the vertical direction is substantially assigned to the lifting unit (20). The vertical components of the tractions exerted by the cables (102) are substantially negligible with respect to the traction exerted by the lifting unit (20).

Advantageously, each winch or hoist (102,103) can be actuated independently of the others. In particular, each winch or hoist (102,103) is controlled by the control module (107) independently of the other winches or hoists (102, 103).

In the embodiment represented in FIGS. 1 and 2, the guide device (10) comprises four winches or hoists (102,103).

In general, the higher the number of winches or hoists (102,103), the higher the number of degrees of freedom of the pick-up module (101) which can be controlled.

Preferably, the cables (102) have at least one terminal section (102*a*) arranged above the pick-up module (101). The terminal section (102*a*) comprises the end connected to the pick-up module (101). In other words, the cables (102) are connected to the pick-up module (101) from above, i.e. with a section that hangs downwards from a support structure (40). In this way, the action exerted by the cables (102) does not oppose the lifting force exerted by the lifting unit (20).

The terminal section (102*a*) of each cable (102) is substantially a free section of the cable (102) itself, which is connected to the pick-up module (101). At the upper end (102*b*) of the terminal section (102*a*) a return element can be arranged, such as for example a pulley or a roller. Such return element can be connected to the support structure (40). Alternatively, the winding means (103) can be connected to the support structure (40), so that the cable (102) extends directly to the pick-up module (101). In that case, the cable (102) extends substantially only along the terminal section (102*a*).

Preferably, the terminal section (102*a*) extends from the support structure (40) to the pick-up module (101) directly, i.e. without the interposition of any return elements.

The perimeter defined by the lines that join the upper ends (102*b*) of the terminal sections (102*a*), projected onto a horizontal plane, is the perimeter inside which the guide device (10), comprising the cables (102), is able to move the pick-up module (101) on that horizontal plane. In the illustrated embodiments, which are preferred but not exclusive, such perimeter is quadrangular, the vertices of which are defined by the upper ends (102*b*) of the terminal sections (102*a*), of which there are four.

The length of each terminal section (102*a*), i.e. the length of the section comprised between the upper end (102*b*) and the pick-up module (101), is variable due to the effect of the intervention of the respective winding means (103). By varying the length of the terminal sections (102*a*) in a controlled and coordinated way, it is possible to obtain a controlled movement of the pick-up module (101).

Preferably, the terminal sections (102*a*) are constrained to the pick-up module (101) in symmetrical points with respect to the centre of gravity of the pick-up module (101).

As already mentioned, the lifting system comprises a support structure (40), installable on the deck (S) and configured to support the winding means (103) and/or at least one section of the cables (102). Support structure (40) means a distinct structure with respect to the pick-up module (101), associated with the deck (S) or part of the deck (S), fixed or movable with respect to the deck (S).

In particular, the support structure (40) is configured to support at least one section of the cables (102) keeping the terminal section (102*a*) hanging. In other words, the support structure (40) is configured so that the terminal section (102*a*) of each cable (102) hangs downwards.

The figures show some examples of support structures (40).

Preferably, the support structure (40), in at least one operating position, can be cantilevered relative to the deck (S), so as to support at least a hanging portion of each cable (102). In other words, the support structure (40), in at least one operating position, comprises at least a portion projecting outside the deck (S), i.e. projecting outside the perimeter of the deck (S). Such a projecting portion enables at least the terminal section (102*a*) of at least one cable (102) to be supported hanging outside the perimeter of the deck (S), so as to guide the connection module (101) in the ways described above.

In the embodiment illustrated in FIG. 1, the support structure (40) comprises two projecting arms (41), which project at least partially outside the perimeter of the deck (S). Such projecting arms (41) support the terminal sections (102*a*) of two cables (102). The respective winding means (103) may likewise be supported by the projecting arms (41), or be placed on top of the deck (S) or of another structure connected thereto. In that case, the cable (102) is guided by one or more returns along one of the projecting arms (41), to be arranged with the terminal section (102*a*) hanging downwards.

In other words, the winding means (103) is installable on the deck (S), whereas the support structure comprises one or more pulleys configured to support at least one section of each cable (102), so that the latter is arranged with its terminal section (102*a*) hanging downwards.

The projecting arms (41) may be fixed, or may be movable, for example slidable along their own longitudinal axis, between an extended position, shown in FIG. 1, in which they support the terminal sections (102*a*) of two cables (102) cantilevered relative to the deck (S), and a retracted position, not shown.

In the embodiment of FIG. 1, two winches or hoists (102,103) are located on the deck (S). In that case, the cables (102) are arranged taut downwards due to the traction effect exerted by the connection module (101).

In the embodiment of FIG. 2, the support structure (40) is movable between a non-operating position, in which it is substantially on top of the deck (S), and an operating position, in which it is cantilevered relative to the deck (S), so as to support at least a hanging portion of each cable (102).

Preferably, each projecting arm (41) is associated with a rotating support (42), provided with an actuator configured to rotate the rotating support (42) itself between a lowered position, in which the structure (40) is arranged in the operating position, and a raised position, in which the structure (40) is arranged in the non-operating position. Preferably, the rotating supports (42) rotate about axes of rotation parallel to one another. Preferably, the axes of rotation of the rotating supports (42) are on at least one edge of the deck (S) facing towards the cables (102).

In the operating position of the structure (40), the projecting arms (41) are arranged cantilevered relative to the deck (S). Preferably, the guide device (10) comprises four winches or hoists (102,103), the cables (102) of which are at least partially supported by the projecting arms (41). In particular, the terminal sections (102*a*) of the cables (102) each hang from one end of the projecting arms (41). As already indicated, the winding means (103) may be integral with the projecting arms (41), as shown in FIG. 2, or could be located on top of the deck (S), with the cables (102) brought to the projecting arms (41) by one or more guide pulleys.

For example, the rotating supports (42) are in the form of articulated parallelograms, which at one end are constrained to the deck (S), whereas at the other end they are constrained to the projecting arms (41). Preferably, the projecting arms (41) are constrained to rotating supports (42) so as not to change the orientation thereof in space during rotation of the rotating supports (42) themselves.

To confer greater rigidity to the support structure (40), the projecting arms (41) may be connected to one another by a crosspiece (43), arranged substantially horizontal.

In a possible embodiment, the lifting unit (20) comprises a pulley (23), associated with the support structure (40), which supports at least a hanging section of the cable (22). Alternatively, the lifting unit itself could be associated with the support structure (40). In particular, the winding means (21) may be associated with the support structure (40).

For example, in the embodiment of FIG. 2, the pulley (23) is associated with the projecting arms (41), in particular with the crosspiece (43). The winding means (21) is, instead, located on top of the deck (S). The cable (22) extends from the winding means (21) to the pulley (23) which enables the deviation of the terminal section (22*a*) downwards.

In the embodiment of FIG. 2, the non-operating position of the support structure (40) can be configured so that the pick-up module (101) is located at a deposit position of the vehicle (3). Such deposit position can be defined, for example by a support, located on top of the deck (S), to keep the vehicle (3) stable. In particular, in the non-operating position of the support structure (40), with the rotating supports (42) in the raised position, the projecting arms (41) are arranged above the deck (S). A support (R) can therefore be located inside the perimeter defined by the top ends (102*b*) of the terminal sections (102*a*), so that the pick-up module (101), through the guide system (10), can deposit the vehicle (3) on the support (R).

Figure 5:
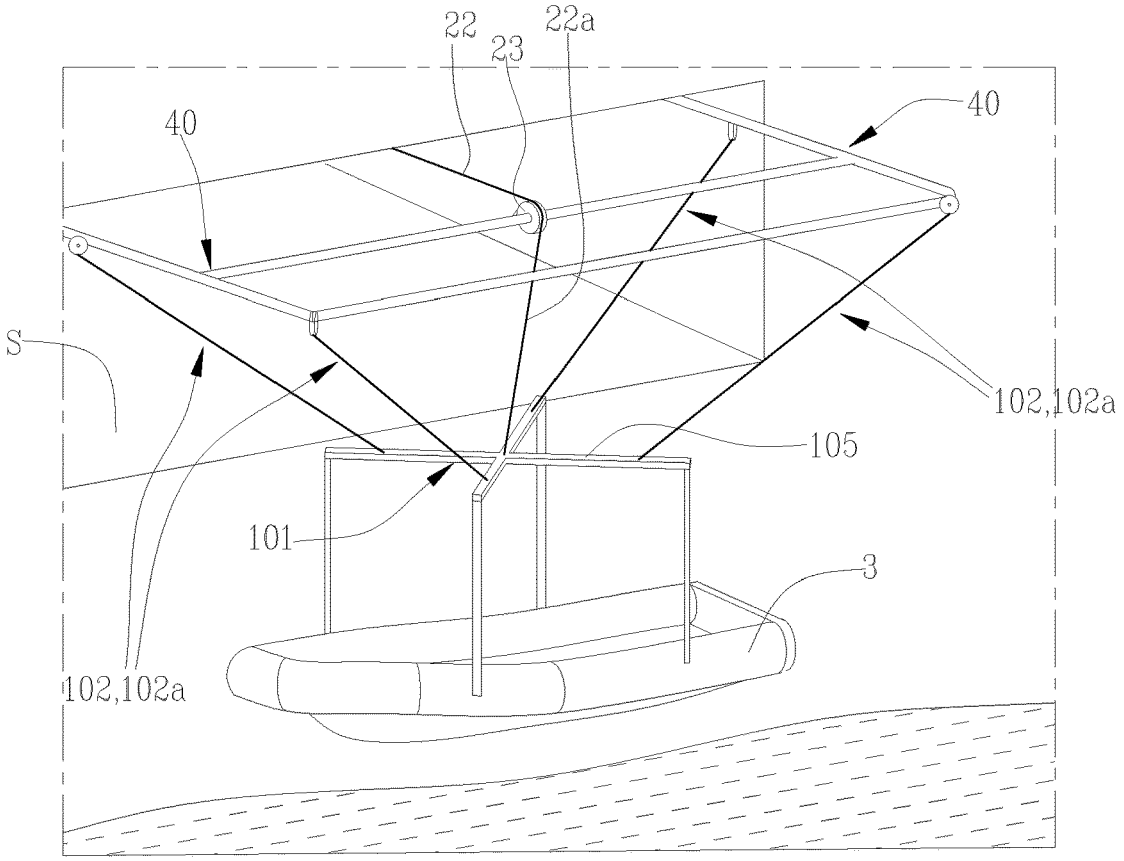
FIGS. 5 and 6 show two further embodiments of the device according to the present invention.

FIG. 5 illustrates a possible variant of the pick-up module (101). In this case, the pick-up module (101) comprises a harness, which can be hooked in a known way through straps, ropes or chains, to the vehicle (3). The harness comprises a cross-shaped support (105), defined by a certain number of arms. Each cable (102) is connected to a respective arm of the cross-shaped support (105). In the illustrated case, the support (105) comprises four arms, each of which is connected to a cable (102). In this case, the guide device (10), by means of the cables (102), regulates the position of the support (105).

Figure 6:
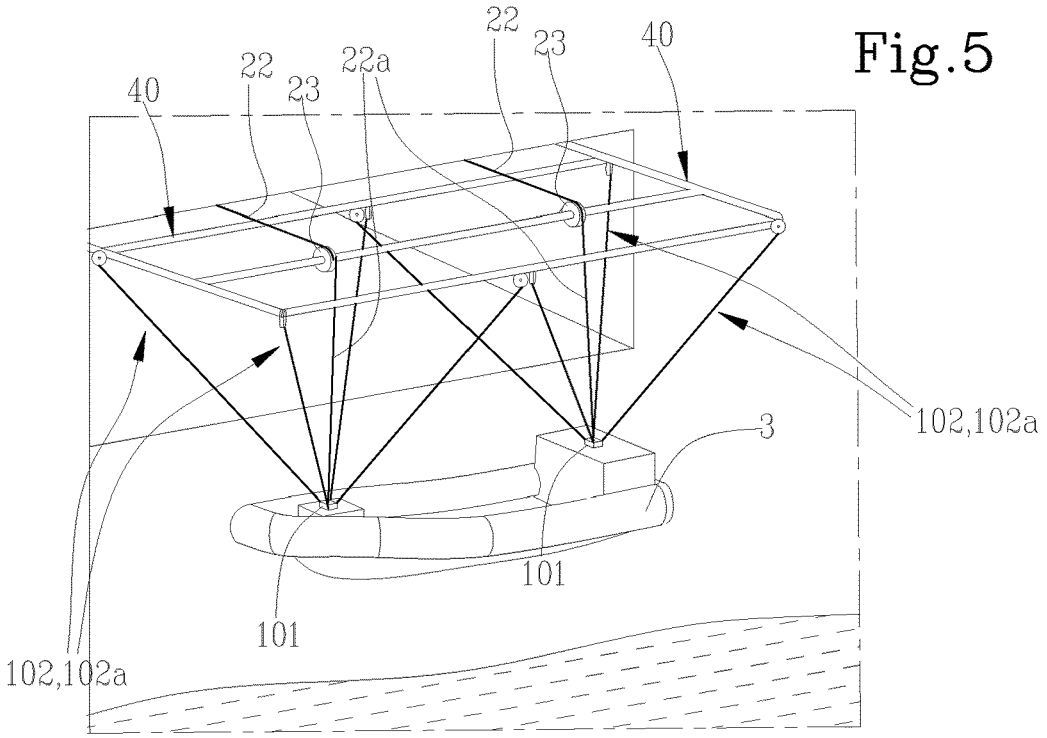
Figure 7:
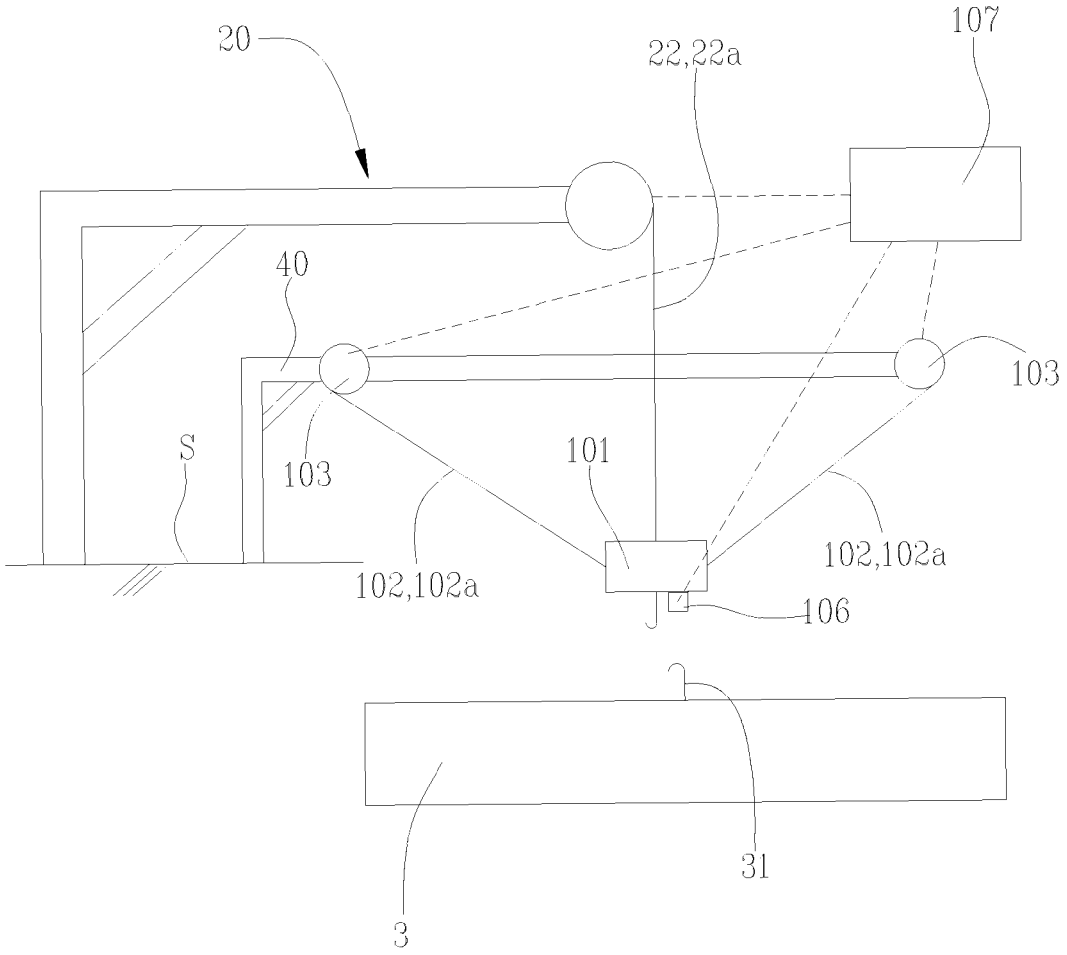
FIG. 7 shows a block diagram of the lifting system according to the present invention, to illustrate the function of a control module (107).

For particularly long and/or heavy vehicles (3), it is possible to envisage the use of two guide devices (10) alongside each other, as shown in FIG. 6. In that case, each guide device (10) regulates the position of its own pick-up module (101), in the ways already described. Each pick-up module (101) is configured to be hooked to a predefined part of the vehicle (3). For that purpose, the vehicle (3) can be provided with two coupling modules (31), configured to be hooked to the pick-up module (101). The two adjacent guide devices are of the type shown in FIG. 1, with a single support structure (40) that supports both.

Advantageously, the lifting system according to the present invention comprises one or more position sensors, which can be associated with the pick-up module (101) and/or with the vehicle (3), configured to transmit a significant signal of the relative position between the pick-up module (101) and the vehicle (3).

For example, said one or more sensors may be: video cameras, laser or Lidar scanners or radio transmitters.

The signal transmitted by said one or more sensors is received by the control module (107), which operates the control of the guide device (10) as a function of the signal received. In particular, the control module (107) actuates the winches or hoists (102,103), varying the lengths of the terminal sections (102*a*) of the cables (102) and consequently modifying the position and/or appearance of the pick-up module (101).

As already indicated, the system preferably comprises a coupling module (31), which can be installed on board the vehicle (3) and configured to be hooked, upon command, with the pick-up module (101). In that case, said one or more sensors are associated with the pick-up module (101) and/or with the coupling module (31). By acting on the guide device (10), i.e. by regulating the lengths of the terminal sections (102*a*) of the cables (102), the control module (107) guides the pick-up module (101) to a predefined position, in which the connection with the coupling module (31) can intervene.

In the embodiment comprising the coupling module (31), a recognition marker can be installed on the vehicle (3) for facilitating the precise localisation, and therefore promoting the precise positioning, of the pick-up module (101). The marker may be of a different type, e.g. it may be passive, configured for the reflection of electromagnetic waves, or be active, configured for emitting visual or radio radiations which can be localised by a sensor on the pick-up module (101).

Preferably, but not necessarily, the pick-up module (101) comprises a positioning control device, configured to control the orientation in space of the pick-up module (101).

The positioning control device is configured to operate in addition to the guide device (10), to add a further control possibility to the position of the pick-up module (101).

In a possible embodiment, the pick-up module (101) comprises a coupling (1011), configured to be engaged with a corresponding part integral with the vehicle (3). For example, the coupling (102) is structured to be able to be engaged with the coupling module (31) associable with the vehicle (3). The positioning control device comprises a kinematic mechanism structured to translate the coupling (102) along at least one sliding direction. The movement of the coupling (1011) causes a displacement of the centre of gravity of the pick-up module (101), and therefore a rotation of the pick-up module (101) itself. This enables the orientation in space of the pick-up module (101) to be modified. The positioning control device is controlled by the control module (107), which operates as a function of the signals received by the sensors appointed to detect the relative position between the pick-up module (101) and the vehicle (3) and/or the coupling module (31).

Preferably, the coupling (1011) and the coupling module (31) are structured so as to be able to create a stable hooking also in imperfect alignment conditions between each other, i.e. also in conditions in which they are not perfectly aligned along an ideal hooking direction. Preferably, the coupling (1011) and the coupling module (31) are structured so as to create a hooking which prevents relative rotation about a vertical axis. This makes it possible to prevent the vehicle being able to rotate on itself during lifting or lowering.

The operation of the guide device substantially takes place in the following ways.

For recovering a vehicle (3), the pick-up module (101) is lowered from an upper stand-by position, by means of the lifting unit (20). In the illustrated embodiment, the pick-up module (101) is lowered, releasing the cable (22). During descent, the pick-up module (101) is guided towards a centred position with respect to the vehicle (3), and in particular with respect to the coupling module (31), by means of the guide device (10). In substance, the pick-up module (101) is translated on its own horizontal plane winding or releasing the cables (102) in a coordinated way. The coordination between the winding and release of the cables (102) is operated by the control module (107) on the basis of the signals received by the position sensors, if present, or on the basis of a command provided by an operator, which can be guided by a viewing system or by direct viewing.

Once the vehicle (3) has been hooked, the pick-up module (101) and the vehicle (3) hooked thereto are lifted by means of the lifting unit (20). During ascent, the pick-up module (101) can be guided by means of the guide device (10), still through coordinated winding or unwinding of the cables (102). During ascent, the pick-up module (101) can be guided, i.e. moved to compensate for any oscillations induced by the movement of the deck (S), the wave motion and/or the wind. For that purpose, the guide device (10) can be provided with dedicated position sensors (106), configured to detect the position of the pick-up module (101) with respect to a predefined reference system, e.g. a reference integral with the deck (S). In a further embodiment, the guide device (10) may be provided with inertia sensors, located on board the pick-up module (101). Such dedicated position sensors are connected to the control module (107) and are configured to send to the control module (107) a significant signal of the position of the pick-up module (101) with respect to a predefined reference system. On the basis of the signal received by the dedicated position sensors, the control module (107) coordinates the winding and unwinding of the cables (102), for moving the pick-up module (101) so as to compensate for the undesired oscillations.

In the embodiment comprising the various sensors and an electromechanical and/or magnetic coupling, the pick-up module (101) requires an electric power supply. For that purpose, a conductor can be combined or inserted into the cable (22) of the lifting unit (20) or into one of the cables (102) of the guide system. Alternatively, a conducting cable, provided with its own winder, can be arranged between an electric power supply, typically arranged on top of the deck (S), and the pick-up module (101).

In the embodiments illustrated and described above, reference has been made to a configuration in which the winding means (103) is remote with respect to the pick-up module (101), i.e. it is arranged on top of the deck (S) and/or the support structure (40).

In an alternative embodiment, the winding means (103) may be arranged on board the pick-up module (101), and the cables (102) may be constrained to the support structure (40) and/or to the deck (S). From a kinematic point of view, the guide device (10), in this alternative configuration, is able to produce the same effects previously described for the illustrated embodiments. One or more winding means (103)

could also be arranged on board the pick-up module (101) and one or more winding means (103) integral with the support structure.

In a further possible embodiment, the guide device (10) comprises a pair of cables (102). Each cable, at least at one end, is wound onto a winding means (103), integral with the support structure. The other end can be fixed or, in turn, be wound onto a winding means (103). Each cable (102) is substantially arranged according to a catenary, i.e. arranged on a vertical plane assuming a curved trend, or with concavity facing upwards. By winding or unwinding the cable (102) at least at one end, it is possible to reduce or increase the length of the free section, and therefore increase or reduce the radius of curvature. Each cable (102) is slidably connected to the pick-up module (101), by means of motorised means with rollers and/or wheels of the known type. In this way, the pick-up module (101) is able to move along the cables (102) at least on a horizontal plane. The winding and unwinding of the cables (102) enable the lifting and lowering of the pick-up module (101), to follow the command of the lifting unit (20) upwards and downwards. The motorised means may be connected to the control module (107), for regulating the movement of the pick-up module (101) on the basis of the direct command of an operator and/or on the basis of the signals coming from the sensors described above. To enable the movement of the pick-up module (101) on a horizontal plane along two perpendicular directions, the two cables (102) are arranged on vertical planes that intersect each other.

The lifting system according to the present invention provides important advantages.

In fact, it enables the pick-up module (101) to be effectively guided on a horizontal plane, so as to enable the correct positioning with respect to the vehicle (3) to be lifted. Furthermore, if provided with the described sensors, the lifting system can operate totally autonomously.

A further important advantage comes from the fact that the guide system is able to compensate for and dampen the oscillations induced by the movement of the deck (S), because of the wave motion and/or the wind.

The invention claimed is:

1. A guided lifting system, comprising:

a lifting unit, installable on a loading deck and configured to exert a lifting force that has at least one vertically directed component;

a pick-up module, operatively connected with the lifting unit and configured to be coupled to a vehicle to be lifted;

a guide device, connected to the pick-up module and configured to move the pick-up module in space in a guided manner;

the guide device being actuated and controlled autonomously from the lifting unit and operating substantially without supporting a load of the vehicle.

2. The lifting system according to claim 1, and further comprising a control module connected to the guide device and configured to actuate the guide device to move the pick-up module in a pre-established manner, as a function of one or more signals indicative of a position of the pick-up module and/or vehicle and/or a position of the pick-up module relative to the vehicle.

3. The lifting system according to claim 1, wherein:

the guide device comprises three winches or hoists, each of which comprises a cable and a winding mechanism, configured to wind or unwind the respective cable;

for each winch or hoist, either the cable or the winding mechanism is operatively connected with the pick-up module, and the other of the cable or the winding mechanism is operatively connected with a support structure;

each winch or hoist is activatable independently of the others.

4. The lifting system according to claim 2, wherein each winch or hoist is controlled by the control module independently of the other winches or hoists.

5. The lifting system according to claim 3, and further comprising a support structure, installable on the loading deck and configured to support the winding mechanism and/or at least a section of each cable.

6. The lifting system according to claim 5, wherein the winding mechanism is installed on the loading deck, and wherein the support structure comprises one or more pulleys configured to support at least a section of each cable.

7. The lifting system according to claim 5, wherein the support structure is cantilevered relative to the loading deck to support at least a hanging portion of each cable.

8. The lifting system according to claim 5, wherein the support structure is movable between a non-operating position, in which the support structure is substantially on top of the loading deck, and an operating position, in which the support structure is cantilevered relative to the loading deck support at least a hanging portion of each cable.

9. The lifting system according to claim 1, wherein the lifting unit comprises a cable, connected to the pick-up module, and a winding mechanism, installed on the loading deck.

10. The lifting system according to claim 5, wherein the lifting unit comprises a pulley, operatively connected with the support structure, which supports at least a hanging portion of the cable.

11. The lifting system according to claim 2, and further comprising one or more sensors, operatively connected with the pick-up module and/or the vehicle, configured to transmit a signal indicative of the relative position between the pick-up module and the vehicle.

12. The lifting system according to claim 11, and further comprising a coupling module, installed on board the vehicle, wherein said one or more sensors are associated with the pick-up module and/or the coupling module.

13. The system according to claim 1, wherein the pick-up module comprises a positioning control device, configured to control an orientation of the pick-up module in space.

14. The lifting system according to claim 3, wherein the winding mechanism is integral with the pick-up module and the cables are associated with the support structure.

15. The lifting system according to claim 3, wherein the cables are operatively connected with the pick-up module and the winding mechanism is operatively connected with the support structure.

16. The lifting system according to claim 3, wherein:

the guide device comprises two cables, each of which, at least at one end, is wound around a winding mechanism integral with the support structure;

each cable is slidably connected to the pick-up module by a motorized mechanism with rollers and/or wheels connected to the control module;

the two cables are disposed on vertical planes that intersect each other.

* * * * *